US005126622A

United States Patent [19]

Jeong et al.

[11] Patent Number: 5,126,622

[45] Date of Patent: Jun. 30, 1992

[54] DISPENSER CATHODE

[75] Inventors: Jong-in Jeong; Jong-seo Choi; Hwan-cheol No; Kyu-nam Ju, all of Suwon, Rep. of Korea

[73] Assignee: Samsung Electron Devices Co., Ltd., Kyunggi-Do, Rep. of Korea

[21] Appl. No.: 610,056

[22] Filed: Nov. 7, 1990

[30] Foreign Application Priority Data

Nov. 9, 1989 [KR] Rep. of Korea ..... 89-16224

[51] Int. Cl.[5] ..... H01J 19/06

[52] U.S. Cl. ..... 313/346 DC

[58] Field of Search ..... 313/346 R, 346 DC

[56] References Cited

U.S. PATENT DOCUMENTS 4,783,613 11/1988 Yamamoto et al. ..... 313/346 R 4,823,044 4/1989 Falce ..... 313/346 DC

*Primary Examiner*—Sandra L. O'Shea

*Attorney, Agent, or Firm*—Cushman, Darby & Cushman

[57] ABSTRACT

A dispenser cathode comprises an electron emissive material including at least one selected from the group consisting of Ba and Ba oxide, a porous metal base body having a plurality of diffusing cavities and positioned on the electron emissive material and an alloy thin film layer consisting of scandium tungstate and tungsten which is disposed between the electron emissive material and the porous metal base body. Instead of the alloy thin film, a pellet containing scandium tungstate may be interposed between said electron emissive material and the porous metal base body. The activation aging time of the dispenser cathode of the present invention is greatly shortened as compared with the conventional dispenser cathode, and the damage of Sc by ion bombardment is prevented, and thus the stable thermoelectron emission can be obtained.

5 Claims, 1 Drawing Sheet

DISPENSER CATHODE

FIELD OF THE INVENTION

The invention relates to a dispenser cathode, and particularly to a cavity reservoir-type dispenser cathode with a high density beam current and a longer lifetime.

BACKGROUND OF THE INVENTION

Generally, a dispenser cathode is classified into cavity reservoir type dispenser cathode, impregnated type dispenser cathode and sintered type dispenser cathode according to the structure and they have a common characteristics of a high density beam current and a longer lifetime. However, these dispenser cathodes are disadvantageous in that they have difficulty in applying to the electron tube such as cathode ray tube because they are operated at high temperature of 1100° to 1200° C.

That is to say, these dispenser cathodes should have a heater of a large calorific value because a large amount of thermal energy is needed in order to generate sufficient thermoelectron emission, and their parts should be made of materials accompanied by no thermal deformation due to the high temperature of heat.

Further, the neighboring parts of the cathode such as control grid and screen grid, and support means of the cathode should be made of heat-resistance material. Therefore, steady researches and developments have been made in order to solve the above problems.

For instance, Japanese patent laid open publication No. 86-13526A describes scandium impregnated type cathode with a low operating temperature of 800° to 900° C. As shown in FIG. 1, this impregnated type cathode is featured in that the thin film layer 1*a* containing W-$Sc_2O_3$ is formed on the surface of the porous metal base body 2*a* impregnated with electron emissive material. But this impregnated type dispenser cathode has other problems such that it has unstable thermoelectron emission caused by a non-uniform distribution of $Sc_2O_3$ and has adverse effect caused by the reaction of Ba oxide with Sc oxide. When Ba oxide is reacted with Sc oxide, $Ba_3Sc_4O_9$ is produced as a by-product and coagulated locally on the surface of the porous metal body 2*a*, which then partly suppresses emission of the thermoelectrons and causes the emissive state of the thermoelectrons to be unstable.

Furthermore, the heat transfer is hindered because the thin film layer containing W-$Sc_2O_3$ is formed on the surface of the porous metal base body impregnated with electron emissive material, and thus the production of scandium tungstate is delayed, and the aging time, i.e., the time required for forming monatomic layer containing Ba-Sc-O on the electron emissive surface becomes very longer, resulting in the decrease of the productivity. Meanwhile, the thin film layer containing W-$Sc_2O_3$ is apt to damage by ion bombardment during operation of the cathode and thus the current density becomes suddenly decreased by loss of a monatomic layer, thereby shortening the lifetime greatly.

SUMMARY OF THE INVENTION

It is an object of the present invention to provide a dispenser cathode in which a high density beam current may be obtained even at a low temperature and which keeps the electron emissive characteristics stable for a longer period.

It is another object of the present invention to provide a dispenser cathode in which the aging time is greatly shortened and the productivity is improved.

To accomplish the above objects, a dispenser cathode according to the present invention comprises an electron emissive material including at least one selected from the group consisting of Ba and Ba oxide and a porous metal base body having a plurality of diffusing cavities and positioned on the electron emissive material, and is characterized in that an alloyed thin film layer consisting of scandium tungstate and tungsten (W) or a pellet containing scandium tungstate is disposed between said electron emissive material and said porous metal base body.

BRIEF DESCRIPTION OF THE DRAWINGS

The above objects and other advantages of the present invention will become more apparent by describing the preferred embodiments of the present invention with reference to the attached drawing, in which.

DETAILED DESCRIPTION OF PREFERRED EMBODIMENTS

Figure 1:
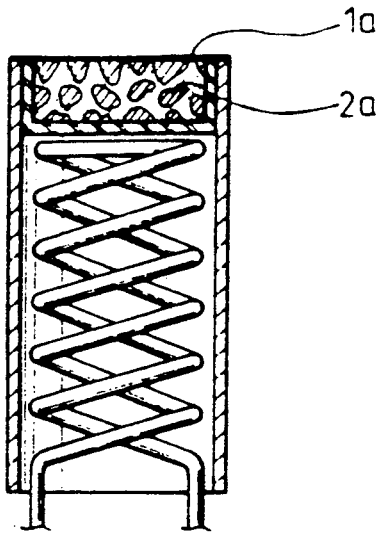
FIG. 1 is a partly sectional view of a conventional Sc impregnated type cathode.
Figure 2:
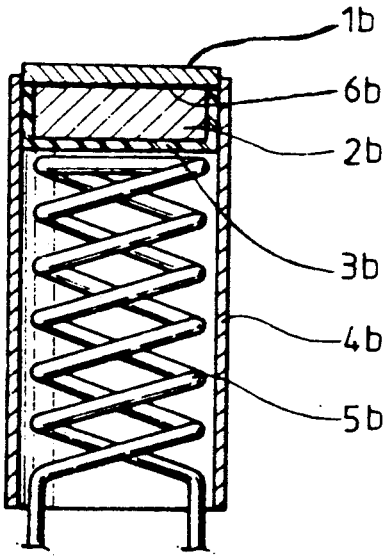
FIG. 2 is a partly sectional view of one embodiment of the cavity reservoir type dispenser cathode according to the present invention.

FIG. 2 shows a cavity reservoir type dispenser cathode according to the present invention. This dispenser cathode has a reservoir 3*b*, an electron emissive material 2*b* stored therein, a porous metal base 1*b* positioned on the electron emissive material 2*b*, an alloyed thin film layer 6*b* positioned between said electron emissive material 2*b* and said porous metal base body 1*b*, and a sleeve 4*b* supporting and fixing said reservoir 3*b* and enclosing the heater 5*b*. The above reservoir 3*b* and sleeve 4*b* is made of a high melting point metal such as Mo and Ta, and said electron emissive material 2*b* is prepared by press-molding barium calcium aluminate.

And the above alloy thin film layer 6*b* consists of scandium tungstate ($SC_2W_3O_{12}$ or $Sc_6WO_{12}$) and tungsten (W). Said porous metal base body 1*b* is prepared by sintering heat-resistance metal powder such as tungsten (W) and, if necessary, it selectively includes the platinum group elements such as Ir, Os, Ru and Re.

Figure 3:
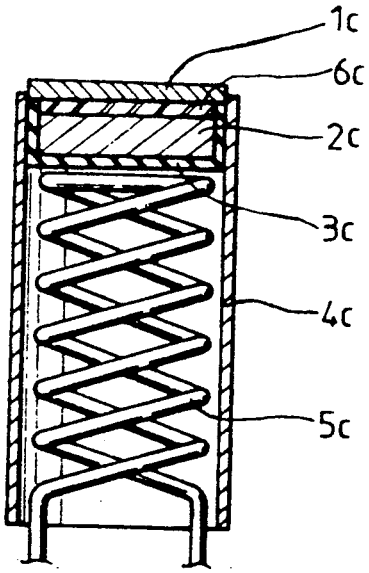
FIG. 3 is a partly sectional view of another embodiment of the cavity reservoir type dispenser cathode according to the present invention.

FIG. 3 shows another cavity reservoir type dispenser cathode of the present invention which is different in structure from the aforesaid embodiment. It comprises a reservoir 3*c*, an electron emissive material 2*c* stored in the reservoir 3*c*, a porous metal base body 1*c* positioned on the electron emissive material 2*c*, a pellet 6*c* interposed between said electron emissive material 2*c* and the porous metal base body 1*c*, and a sleeve 4*c* which supports and fixes the reservoir 3*c* and encloses a heater 5*c*.

The reservoir 3*c* and the sleeve 4*c* are made of high melting point metal such as Mo, Ta, etc., and the electron emissive material 2*c* is prepared by press-molding barium calcium aluminate.

The pellet 6*c* is made by press-molding scandium-tungstate such as $Sc_2W_3O_{12}$ powder or $Sc_6WO_{12}$ powder, or the mixture thereof. The above porous metal base body 1c is made by sintering heat resistant metal powder such as W, and if necessary, may selectively contain platinum-group elements of Ir, Os, Ru, Re, etc.

The method for manufacturing the dispenser cathode according to the present invention will be explained below.

1) $BaCO_3$, $CaCO_3$ and $Al_2O_3$ are mixed at a mole ratio of 4:1:1 or 5:3:2 and then they are baked at a temperature range of 1200° to 1400° C. for about 8 hours. After baking, the baked barium calcium aluminates are mixed with tungsten powder at a ratio of 80:20 to 50:50 wt %.

2) W powder and $Sc_2O_3$ powder are mixed with each other and then they are baked under an oxidizing atmosphere to prepare a scandium tungstate ($Sc_2W_3O_{12}$ or $Sc_6WO_{12}$). Then, tungsten (W) is mixed therewith and a target for sputtering is manufactured. At this time, the component ratio is adjusted in order for scandium tungstate to be 2 to 50 wt % based on total weight.

3) Tungsten powder having particle diameter of about 5 μm is press-molded and then is sintered to prepare the porous metal base body. Here, it selectively includes the platinum group element such as Ir and Os.

4) Metal powder mixture of said barium calcium aluminate and tungsten W, manufactured through said steps is stored in a reservoir 3b and is pressed to be molded into the electron emissive material 2b within the reservoir 3b.

5) Said target consisting of scandium tungstate and tungsten W is sputtered over the lower surface of said porous metal base body or the upper surface of said electron emissive material to form a thin film layer having a thickness of 50 to 5,000 nm.

6) Said porous metal base body 1b is fixed on the reservoir 3b by welding.

As described above, since the cavity reservoir type dispenser cathode according to the present invention has the thin film layer 6b serving as Sc supply source positioned between the porous metal base body and the electron emissive material, and said Sc is an element generating Ba-Sc-O monatomic layer of a lower work function, the generation of the by-product on the electron emissive surface by the reaction of Sc oxide and Ba oxide is prevented, as described in detail below. When the electron emissive material is heated by the heater, scandium tungstate and Ba positioned at the lower portion of the porous metal base body are reacted with each other to produce scandium Sc through the following reaction equation:

$$Sc_2W_3O_{12}+3BaWO_4+2Sc$$

Then, the evaporated Sc is diffused into the cavity of the porous metal base body together with diffuse Ba and then they arrive at the surface of the porous metal base body to form a monatomic layer consisting of Ba-Sc-O. The by-products generated from the reaction of Ba oxide with Sc oxide are produced at the lower portion of the porous base body, but fail to reach the surface of the porous metal base body. Thus, the monatomic layer having a uniform distribution can be formed on the surface of the porous metal base body, thereby keeping the thermoelectron emission stable for . longer period.

Further, the activation aging time the dispenser cathode according to the present invention is about 2 hours, which is remarkably shortened in view of the fact that the activation aging time of the conventional Sc impregnated type cathode is 10 hours. In the conventional Sc impregnated type cathode, a thin film layer consisting of W and $Sc_2O_3$ is formed on the surface of the electron emissive material, and therefore heat transfer thereto from the heater is not facilitated, hindering the generation of the scandium tungstate. On the other hand, in the present cathode, scandium tungstate is disposed between the porous metal base body and the electron emissive material, facilitating the generation of the evaporated Sc.

In addition, the thin film layer containing scandium tungstate-W as Sc supply source is not positioned on the surface of the porous metal base body with severe ion bombardment but positioned at the lower portion thereof, so that the damage of the thin film layer by ion bombardment is not brought about. Even though monatomic layer formed by the activation aging is damaged by ion bombardment during operation of the cathode, it can be recovered easily and accordingly causes the thermoelectron to be emitted stably because the evaporated Sc continuously reaches the surface of the porous metal base body.

What is claimed is:

1. A dispenser cathode comprising:

an electron emissive material including at least one selected from the group consisting of Ba and Ba oxide;

a porous metal base body having a plurality of diffusing cavities therewithin and positioned on said electron emissive materials; and an alloy thin film layer consisting of scandium tungstate and tungsten and disposed between said electron emissive material and said porous metal base body.

2. The dispenser cathode as claimed in claim 1, wherein said scandium tungstate includes at least one selected from the group consisting of $Sc_2W_3O_{12}$ and $SC_6WO_{12}$.

3. The dispenser cathode as claimed in claim 1, wherein the content of scandium tungstate is 2 to 50% based on total weight of said thin film layer.

4. A dispenser cathode comprising:

an electron emissive material including at least one selected from the group consisting of Ba and Ba oxide;

a porous metal base body having a plurality of diffusing cavities therewithin and positioned on said electron emissive material; and a pellet containing scandium tungstate and interposed between said electron emissive material and said porous metal base body.

5. The dispenser cathode as claimed in claim 4, wherein said scandium tungstate contains at least one selected from the group consisting of $Sc_2W_3O_{12}$ and $Sc_6WO_{12}$.

* * * * *